United States Patent [19]

Musacchia

[11] Patent Number: 4,558,868

[45] Date of Patent: Dec. 17, 1985

[54] ARROWHEAD WITH INTERCHANGEABLE ELEMENTS

[76] Inventor: John Musacchia, P.O. Box 452, Marathon, Fla. 33050

[21] Appl. No.: 569,879

[22] Filed: Jan. 11, 1984

Related U.S. Application Data

[63] Continuation-in-part of Ser. No. 535,066, Sep. 23, 1983.

[51] Int. Cl.[4] ..... F41B 5/02

[52] U.S. Cl. ..... 273/422

[58] Field of Search ..... 273/422, 421, 419, 420

[56] References Cited

U.S. PATENT DOCUMENTS

| | | | |
|---|---|---|---|
| 2,905,470 | 9/1959 | Hoyt, Jr. | 273/421 X |
| 3,614,103 | 10/1971 | Carroll | 273/422 |
| 3,741,542 | 6/1973 | Karbo | 273/422 |
| 3,915,455 | 10/1975 | Savora | 273/422 |
| 3,945,642 | 3/1976 | Henthorn, Jr. | 273/421 X |

OTHER PUBLICATIONS

Archery, 10-1972, p. 29, Robin Hood Change-A-Points.

Archery, 2-1977, p. 6, Talon.

*Primary Examiner*—Paul E. Shapiro

*Attorney, Agent, or Firm*—Emory L. Groff, Jr.

[57] ABSTRACT

Arrowhead capable of being converted, by interchange of head elements, from an archery head to any selected one of various types of hunting heads. Comprises an elongated main body having an axially extending space and a plurality of longitudinal slots, both the slots and the axially extending space opening through the same end of the body, the slots also opening laterally both outwardly and into the axially extending space so that a blade assembly can be inserted into the main body via the slots and the axially extending space. The body also includes a stop surface, which may be a blind end of the axially extending space or a blind end of each slot or both, against which the blade assembly is clamped axially by a closure member which is releasably secured to the end of the main body through which the slots open.

17 Claims, 30 Drawing Figures

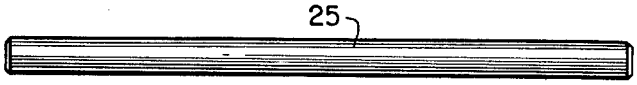
FIG. 6
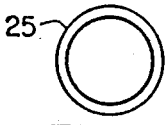
FIG. 7
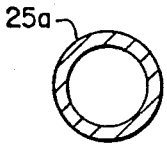
FIG. 8
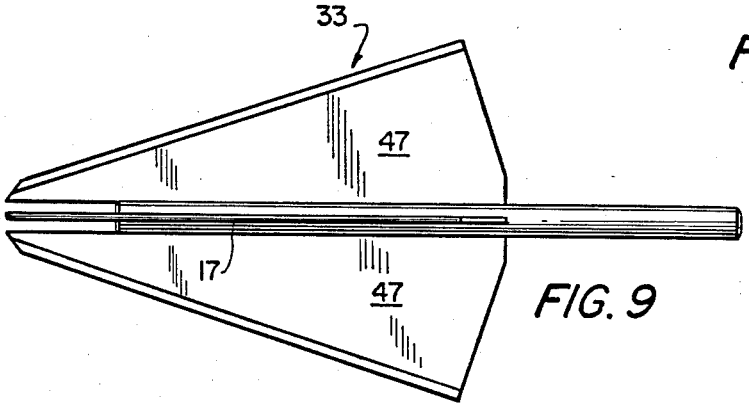
FIG. 9
FIG. 10
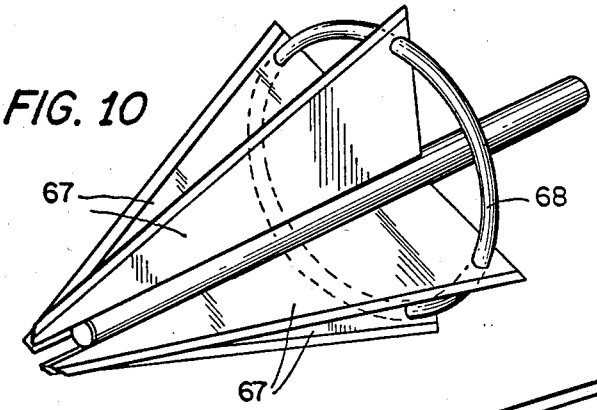
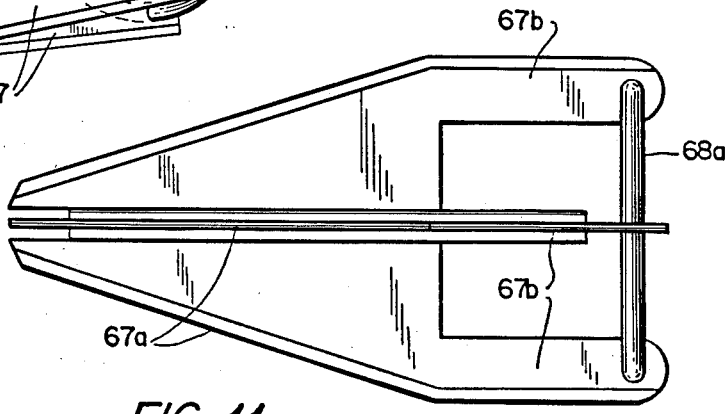
FIG. 11

82
78
75
77
13
13
71
76
77'
74a
74
79

71
77
79

82
96
97
75a
77a 112
102
114
101b
101
107
109
101a 73
87c
87
86
87c
87
87
87d
87d
87b
87a
84
85
72
95
82
71
75
77
86
87
87
87
79
74a
84
85
95
72

116a
103
117c
117
116
117
117
117d
117a
117b
117e
120
104

FIG. 20
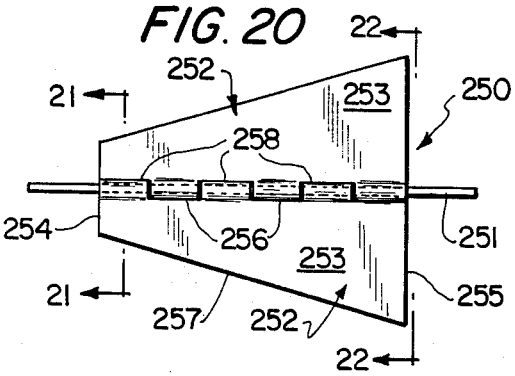
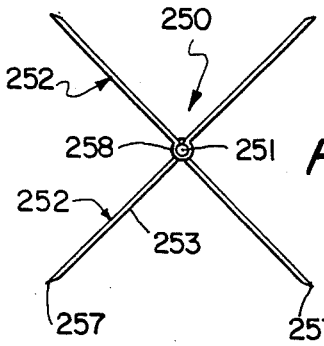
FIG. 22
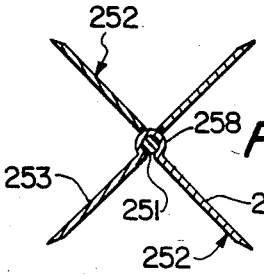
FIG. 21
FIG. 26
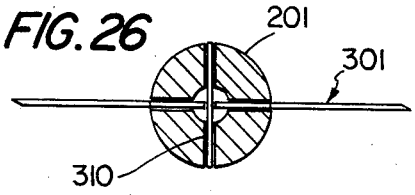
FIG. 23
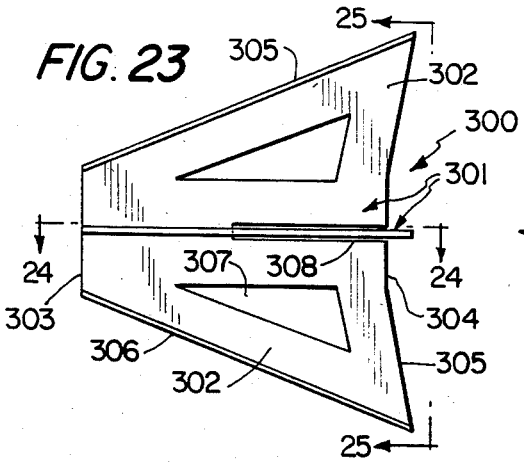
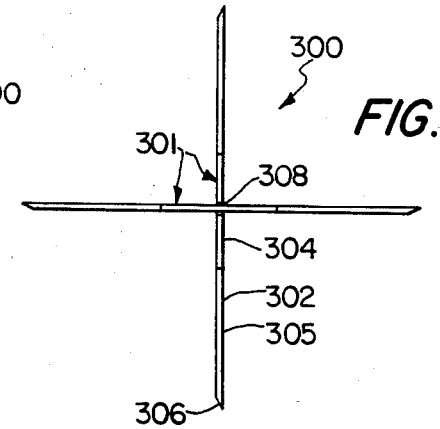
FIG. 25
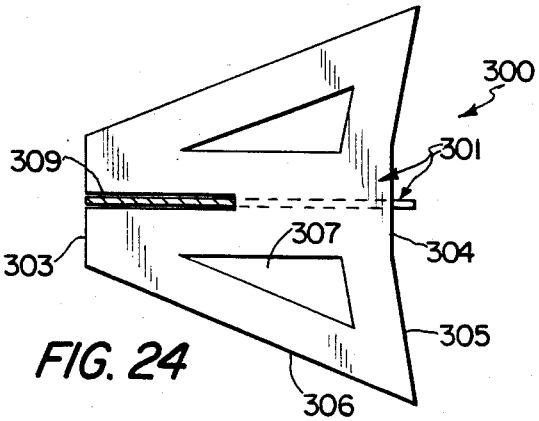
FIG. 24
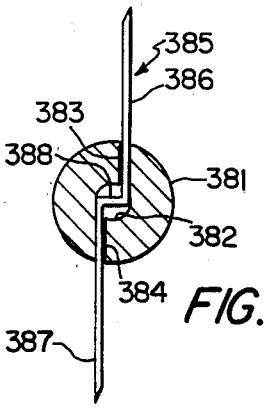
FIG. 30

ARROWHEAD WITH INTERCHANGEABLE ELEMENTS

RELATED APPLICATION

This application is a continuation-in-part of my application Ser. No. 535,066, filed Sept. 23, 1983.

The invention relates to arrowheads and provides an arrowhead in which head elements can be interchanged to suit the purpose for which the arrowhead is to be used, particularly advantageous embodiments of the invention affording that capability for conventional arrow shafts which have already been acquired by the archer.

BACKGROUND OF THE INVENTION

The sport of archery includes activities ranging from target practice to game hunting, and the art of providing arrows suitable for each of such purposes has become highly developed. A great many types of arrowheads have been developed, with each designed to serve a particular purpose and having specific operating characteristics. Thus, arrowheads specifically intended for hunting large, thick-skinned, heavy-boned game such as bear have been developed as well as heads particularly suitable for hunting large thinner-skinned, lighter-boned game such as deer. Arrowheads have also been developed for hunting fowl, particularly turkey, for hunting squirrels and other small game, and for bow-fishing. When such specially designed arrowheads are attached to the arrow shaft in non-releasable fashion, it is necessary for the archer to have a wide range of arrows, some for target shooting, some for hunting larger game, some for smaller game. Prior-art workers therefore proposed arrows having interchangeable heads, in an effort to reduce the number of arrow shafts which might be required, as in U.S. Pat. Nos. 2,289,284 Chandler and 3,910,579 Sprandel, but such approaches require replacement of the entire arrowhead and therefore have the drawback that a complete new arrowhead must be manufactured for each intended use.

Arrowheads with interchangeable blades have been proposed by prior-art workers in an effort to increase the versatility of the arrowhead while economizing in the amount of materials needed for production. Systems typical of this general approach are disclosed in U.S. Pat. Nos. 2,940,758 Richter, 4,036,479 Sherwin, 4,146,226 Sorenson and 4,210,330 Kosbab. Such systems typically employ a plurality of independent blades each of which can be fitted into a different one of a plurality of slots in a central body. Usually, the blades are then clamped by axially-acting clamp members which are separate from the arrowhead body, or the body itself may act as a clamp member. Such systems are cumbersome to assemble because each blade must be handled individually. Further, since a plurality of blades are clamped, the blades tend to be held less securely and tend to become loose during use. Since the blades themselves must be clamped to the arrowhead body, there is an increased liklihood that the blades will fracture or shear on impact, at or near the points where the blade is clamped.

U.S. Pat. Nos. 3,741,542 Karbo and 4,349,202 Scott illustrate prior-art arrowheads in which blade assemblies comprising two or more blades are releasably secured to the arrowhead body. Though such arrowheads represent a distinct improvement in the art, they have the deficiency that, when the blades are of substantial size, the clamping forces are applied to only a limited portion of the blade, so that the blade is likely to fracture or distort under the rigors of use. In other approaches, as in U.S. Pat. No. 3,398,960 Carroll, a blade structure is positioned over a central shaft and locked thereto, but such approaches have the deficiency that the entire blade structure is external and more easily deformed or loosened on impact. While prior-art proposals have achieved significant acceptance in the trade, there has been a continuing need for improvement, particularly in the ease of assembly of the arrowhead and its ability, once assembled, to withstand the rigors of actual use.

OBJECTS OF THE INVENTION

A general object of the invention is to devise an arrowhead having assemblies of blades or other head elements which are easily interchangeable with a minimum of effort in a manner such that, once assembled with a chosen blade assembly, the arrowhead will effectively withstand impact.

Another object is to provide such an arrowhead wherein the blades or other interchangeable head elements are rigidly secured to the arrowhead in a fashion providing a higher degree of reliability than has heretofore been achieved.

A further object is to devise such an arrowhead wherein assemblies of blades or other head elements are employed in a fashion such that, despite ease of interchange of the assemblies, blade fracture on impact is less likely than has heretofore been the case.

A still further object is to provide an arrowhead which is readily convertible from a target head to various types of hunting heads and back to a target head.

Another object is to achieve true head-to-shaft alignment when such an arrowhead is attached to the arrow shaft.

Yet another object is to devise such interchangeable arrowheads which can be fitted readily to conventional arrow shafts already in the hands of the archer.

SUMMARY OF THE INVENTION

Arrowheads according to the invention comprise a main body adapted to be secured to the tip of an arrow shaft, a blade assembly to be fitted into and carried by the main body, and a closure member at one end of the main body to place the blade assembly under an axial clamping force. The body has a leading end, an intermediate portion and a trailing end; an axial space which opens through one end of the body and extends for at least a substantial part of the length of the body; a plurality of slots which extend both longitudinally and laterally relative to the body, open longitudinally through said one end of the body and open both outwardly through the outer surface of the body and inwardly into the axial space; and at least one internal stop surface which is spaced from said one end of the body toward the other end, faces toward said one end and is axially exposed toward said one end via either the axial space or the slots. The blade assembly is unitary in the sense of being able to be handled as one piece, comprises at least two blades, and is constructed and arranged to be inserted into the main body via the open ends of the axial space and the slots until the blades are each accommodated by a different one of the slots and the assembly is engaged with said at least one internal stop. The closure member is releasably secured as part of the arrowhead in a location such as to close the open ends of the slots and secure the blade assembly in a position in which the assembly is clamped axially against said at least one stop.

In some embodiments, the blade assembly comprises an elongated mandrel which carries the blades, and the axial space in the body is a bore having a blind end which constitutes the stop surface and is engaged by an end of the mandrel when the blade assembly is clamped in place. In other embodiments, the blade assembly does not require a mandrel, two blade units being mutually interengaged along the longitudinal central axis of the blade assembly. For target shooting, the blade assembly can simply be removed, in some embodiments, or can be removed and replaced by a bladeless mandrel, in other embodiments. Various blade elements and blade assemblies, all useful with the same main body and closure member, are provided.

IDENTIFICATION OF THE DRAWINGS

FIGS. 6 and 7 are a side elevational view and an end elevational view, respectively, of a bladeless mandrel which can be substituted for the blade assembly shown in FIG. 4;

FIG. 8 is a transverse cross-sectional view of an alternative form of the mandrel;

FIG. 9 is a side elevational view of a four-bladed assembly which can be substituted for the assembly of FIG. 4;

FIG. 10 is a perspective view of another form of blade assembly according to the invention;

FIG. 11 is a side elevational view of a modified form of the blade assembly shown in FIG. 10;

FIG. 20 is a side elevational view of another form of blade assembly useful in accordance with the invention, FIG. 21 is a transverse cross-sectional view taken on line 21—21, FIG. 20, and FIG. 22 is an end elevational view taken on line 22—22, FIG. 20;

FIG. 23 is a side elevational view of another form of blade assembly according to the invention, FIG. 24 is a longitudinal cross-sectional view taken on line 24—24, FIG. 23, and FIG. 25 is an end elevational view taken on line 25—25, FIG. 23;

FIG. 26 is a view partly in end elevation and partly in transverse cross section illustrating use of a modification of the blade assembly of FIGS. 23–25;

Figures 17, 18, 19, 27, 28, 29:
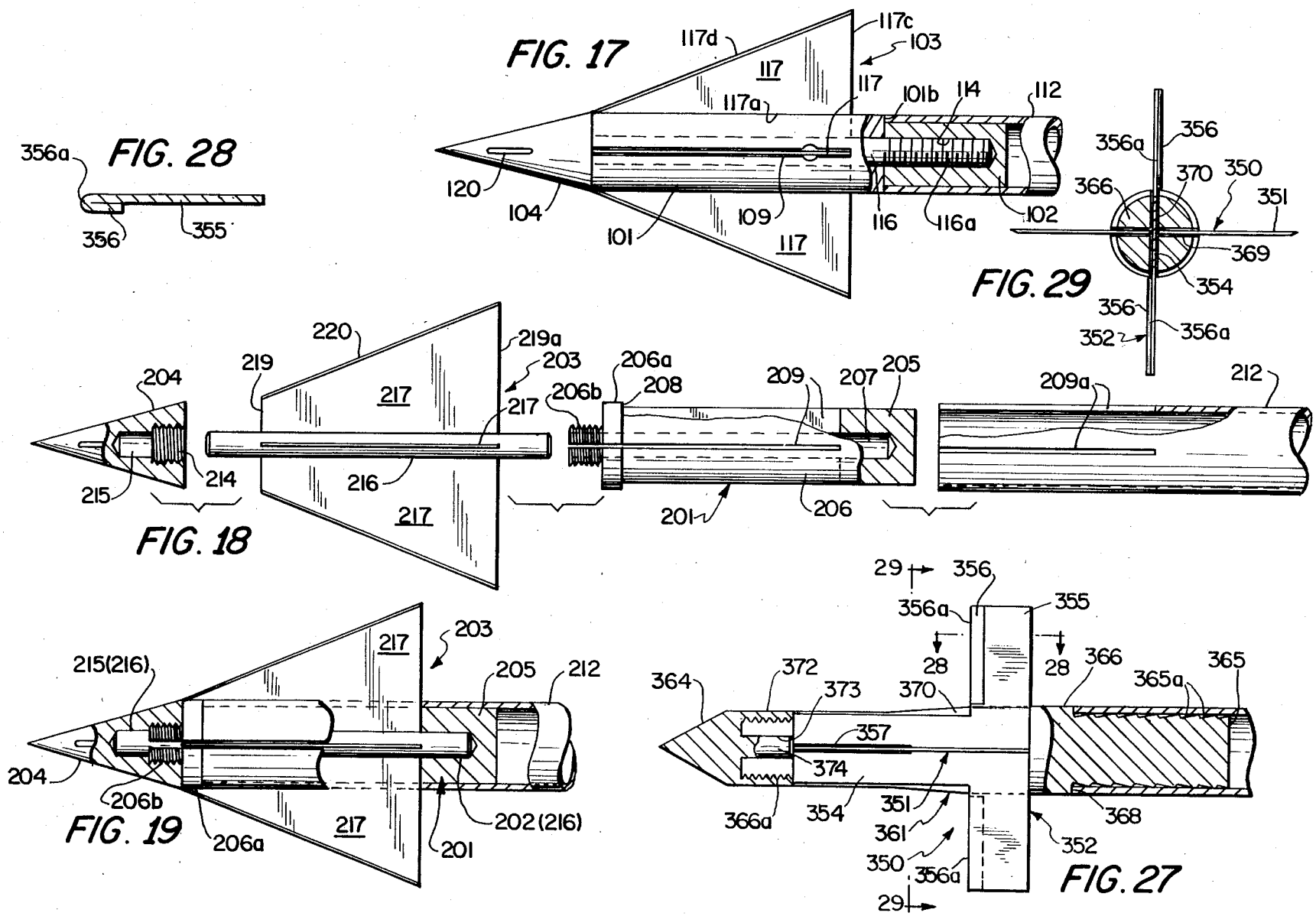
FIG. 17 is a side elevational view of that arrowhead with parts fully assembled.
FIG. 18 is an exploded view of an arrowhead according to another embodiment.
FIG. 19 is a side elevational view of that arrowhead with parts fully assembled.

FIG. 27 is a longitudinal cross-sectional view, with parts shown in side elevation, of an arrowhead according to another embodiment, and FIGS. 28 and 29 are cross-sectional views taken respectively on lines 28—28 and 29—29, FIG. 27; and FIG. 30 is a transverse cross-sectional view of a main body member and blade assembly according to another embodiment.

DETAILED DESCRIPTION OF THE INVENTION

Embodiment of FIGS. 1–5

In this embodiment, the arrowhead includes a main body 1, a closure member 2 which serves also as an adaptor, and a blade assembly 3. Body 1 has a forwardly tapering conical tip 4, a trailing end portion 5 and an elongated intermediate portion 6. Intermediate portion 6 has a right circular cylindrical outer surface and the body is provided with an axial bore 7 which opens through the trailing end of the body and extends forwardly for most of the length of intermediate portion 6, the bore being coaxial with the outer surface of the intermediate portion. Trailing portion 5 is of smaller outer diameter than the intermediate portion, terminates at its forward end in a transverse annular shoulder 8 and is externally threaded throughout its length. Body 1 has four slots 9 which lie in planes which are radial with respect to the axial bore, extend longitudinally for the full length from the leading end of bore 7 through the trailing end of portion 5 and extend radially through the entire thickness of the tubular wall which defines bore 7. The slots are spaced apart circumferentially by 90° that opposed pairs of the slots lie in common planes which include the longitudinal axis of body 1. Forwardly of the leading end of bore 7, each slot 9 is extended by an outwardly opening groove 10 which extends through the conical surface of tip 4.

Figure 1:
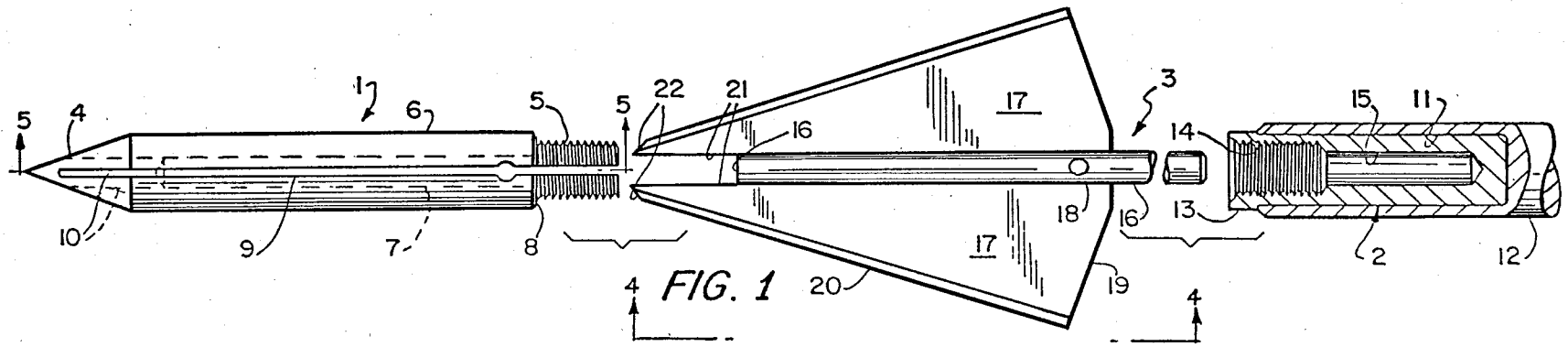
FIG. 1 is an exploded view of an arrowhead according to one embodiment of the invention, with parts shown in side elevation.

Adaptor 2 is shaped and dimensioned to be snugly embraced by wall 11 of a forwardly opening bore in the tip of arrow shaft 12, FIG. 1, and has a transverse annular outwardly projecting shoulder 13 at its leading end, the shoulder engaging the end of the arrow shaft as shown. At its leading end, the adaptor has a threaded bore portion 14 capable of being threaded onto the externally threaded trailing end portion 5 of body 1. An axial blind bore 15 extends from threaded portion 14 to a point short of the trailing end of the adaptor, bore 15 being of the same diameter as bore 7 and bores 15 and 7 being coaxial when assembly of the arrowhead is completed.

Figure 3:
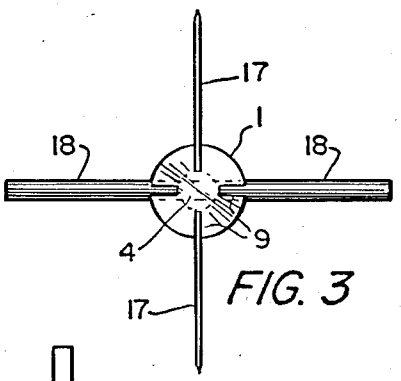
FIGS. 2 and 3 are a side elevational view and a front elevational view, respectively, of the arrowhead of FIG. 1 with the parts fully assembled.
Figure 4:
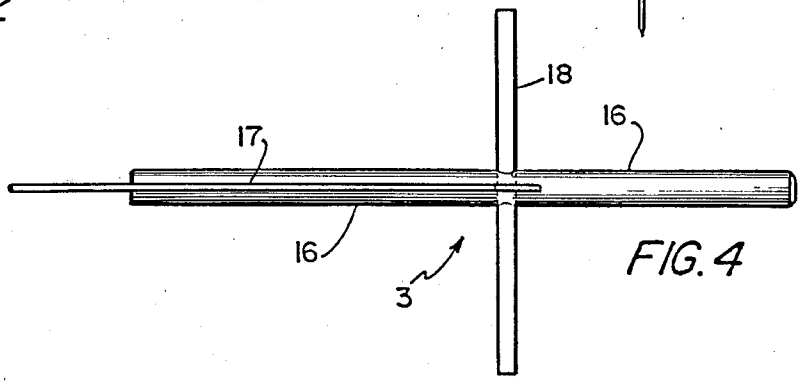
FIG. 4 is a side elevational view of the mandrel, blade and cross rod assembly, taken generally on line 4—4, FIG. 1.
Figure 2:
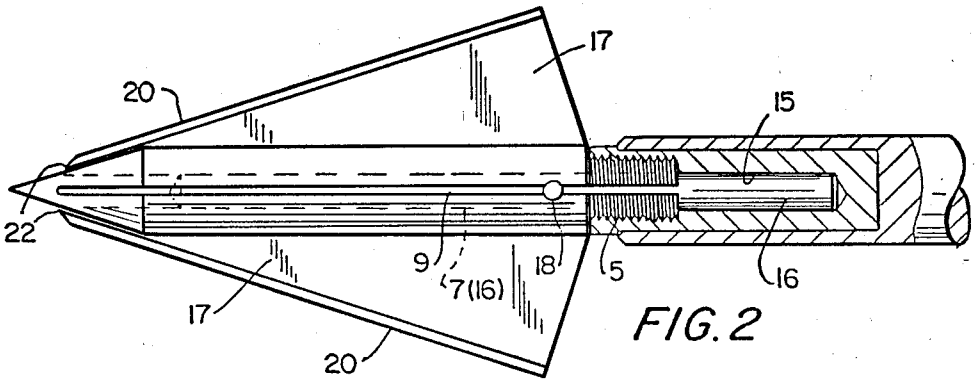
Figure 5:
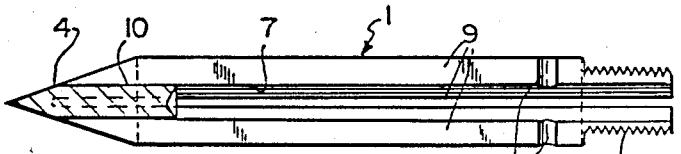
FIG. 5 is a longitudinal cross-sectional view of the main body, taken generally on line 5—5, FIG. 1.

Blade assembly 3 comprises a mandrel 16, two blades 17 and a cross rod 18. The mandrel is in the form of a straight, rigid rod having a right circular cylindrical outer surface of a diameter such that the mandrel can be slidably embraced by the walls of bores 7 and 15. The length of the mandrel is such that, when the mandrel is inserted forwardly into bore 7 and adaptor 2 is fully threaded onto portion 5 of body 1, the blind ends of bores 7, 15 are engaged axially with the respective ends of the mandrel. Blades 17 are identical and generally triangular, each having a trailing edge 19 and a straight cutting edge 20. For most of the length of the blade, the remaining edge extends along and is rigidly joined to the mandrel, the arrangement being such that the two flat blades lie in a common plane which includes the longitudinal axis of the mandrel. With the blades and the mandrel both of metal, the blades and mandrel can be integral or the blades can be separate elements rigidly affixed to the mandrel in any suitable fashion, as by fused metal or adhesive. Tip portions of the blades extend beyond the leading end of the mandrel and are defined by inner edge portions 21, portions of the cutting edges of the blades, and short leading edges 22 which slant from the cutting edge of the blade forwardly and inwardly at an angle considerably greater than that at which the outer surface of tip 4 of body 1 tapers. Cross rod 18 is straight and of smaller diameter than the mandrel and extends through a suitable transverse bore in the mandrel, the cross rod being centered on the mandrel as seen in FIGS. 3 and 4. Near trailing end portion 5 of body 1, the walls defining a diametrically opposed pair of slots 9 are interrupted by straight radially extending grooves 23 which are of arcuate transverse cross section and of such diameter as to define radial bores to snugly embrace cross rod 18, the axial positions of grooves 23 being such that the cross rod will be engaged in grooves 23 when the mandrel has been inserted forwardly into bore 7 until the leading end of the mandrel engages the blind end of bore 7.

To assemble the arrowhead of FIGS. 1–5, adaptor 2 is first secured in the hollow tip of arrow shaft 12 in conventional fashion, as by being cemented in place. Blade assembly 3 is then held manually behind body 1, with cross rod 18 aligned with the opposed pair of slots 9 which have grooves 23. The blade assembly is then inserted into the body, with mandrel 16 entering bore 7, cross rod 18 being forced into the pair of slots 9 which have grooves 23, and blades 17 each entering a different one of the two remaining slots 9. Insertion is continued until the tip of the mandrel engages the blind end of bore 7, cross rod 18 snaps into grooves 23 and the tip portions of the blades extend forwardly into the respective ones of axial grooves 10 with leading edges 22 of the blades being at the forward ends of grooves 10 and cutting edges 20 being fully exposed throughout their lengths. Male threaded trailing end portion 5 of body 1 is then threaded into female threaded portion 14 of adaptor 2 until the trailing end of mandrel 16 engages the end of bore 15 so that the mandrel is clamped axially between the blind ends of bores 7 and 15. It will be noted that the four slots 9 extend completely through trailing end portion 5 of body 1, rendering that portion capable of limited resilient distortion, first to allow entry of the cross rod into two of the slots, next to allow full threading of portion 5 into bore portion 14 to result in clamping portion 5 of body 1 very tightly against mandrel 16. With the parts thus assembled, mandrel 16 is secured rigidly within body 1 and is prevented from lateral movement because of being embraced by the walls of bores 7 and 15. In addition to being rigidly joined to mandrel 16, blades 17 are restrained and supported by the side walls of slots 9 and grooves 10, such restraint and support being afforded throughout the lengths of the blades. Similarly, cross rod 18 is not only joined rigidly to the mandrel but is also supported and restrained by coacting grooves 23. Further, since threading of body portion 5 into bore portion 15 results in full insertion of the trailing end portion of the mandrel into bore 15, true axial alignment of the arrowhead with the arrow shaft is assured.

The blade assembly shown in FIGS. 3 and 4 has the advantage of including both penetrating and cutting blades 17 and a penetration limiting and impact element in the form of cross rod 18.

Use of Mandrels of FIGS. 6–8

Should the archer have been hunting with the blade assembly just described and wish to engage in target shooting, the arrowhead of FIGS. 1–5 is removed from the arrow shaft simply by unthreading body portion 5 from adaptor 2. Blade assembly 3 is then withdrawn from body 1 and replaced by mandrel 25 of FIGS. 6 and 7 or mandrel **25*a* of FIG. 8. Portion 5 of body 1 is then again threaded into bore portion 14 of adaptor 2 until the bladeless mandrel is engaged endwise between the blind ends of bores 7 and 15. Choice of the hollow mandrel 25*a*** results in a lighter head without undue loss of strength imparted by the mandrel.

Blade Assembly of FIG. 9

For hunting large game, the archer may choose to replace the blade assembly of FIGS. 1–5 with the four-bladed assembly 33 of FIG. 9. Assembly 33 is like that of FIGS. 3 and 4 except that cross rod 18 is omitted and two additional blades 47 provided in its place, the two additional blades being identical to blades 17 and being rigidly secured to the mandrel in such fashion that the four blades are spaced apart by 90° about the longitudinal axis of the mandrel. Assembly 33 is installed in body 1 in the manner hereinbefore described, save that the four blades occupy all of the four slots.

Embodiment of FIGS. 10 and 11

FIG. 10 illustrates the manner in which an impact element, serving also to limit penetration, can be provided in a four-bladed assembly such as that described with reference to FIG. 9. Here, each blade 67 is provided with an aperture located in the outer trailing corner area of the blade, all of the apertures lying in a common plane at right angles to the axis of the mandrel. Impact element 68 is in the form of a resiliently deformable metal split ring which is threaded through the apertures in all four blades 67, the ends of the ring then being welded, brazed or cemented within the aperture of one of the blades.

In the modification illustrated in FIG. 11, each blade **67*a* is provided with a rearward extension 67*b*, the apertures are disposed near the ends of extensions 67*b*, and ring 68*a* thus extends through the apertures in the trailing ends of the extensions, providing for greater penetration before ring 68*a*** acting as an impact and stop element, comes into play.

Figures 12, 13, 14, 15, 16:
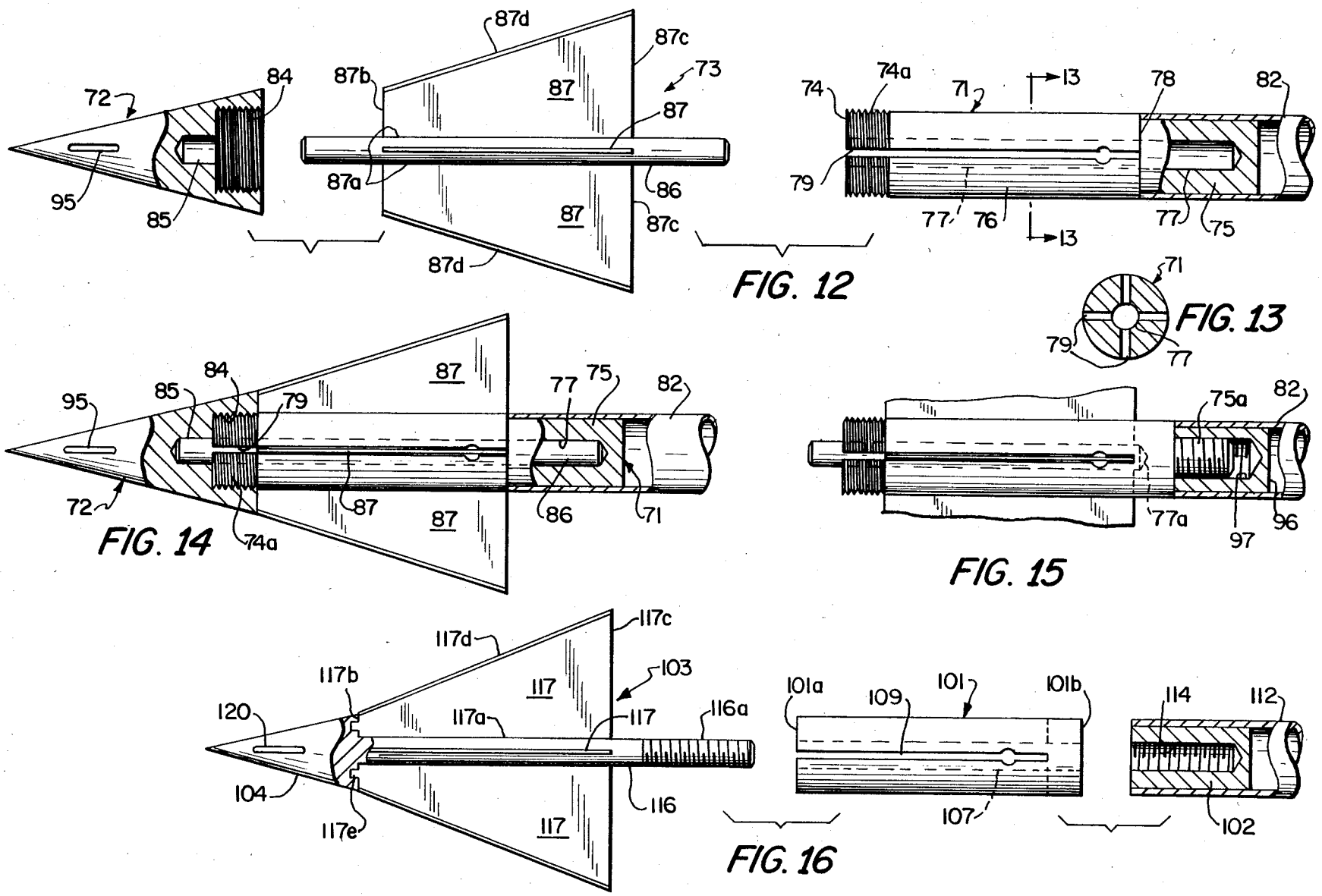
FIG. 12 is an exploded view of an arrowhead according to another embodiment of the invention and FIG. 13 is a transverse cross-sectional view taken on line 13—13, FIG. 12.
FIG. 14 is a side elevational view of the arrowhead of FIG. 12 with parts fully assembled.
FIG. 15 is a fragmentary side elevational view showing a modification of the embodiment of FIGS. 12–14.
FIG. 16 is an exploded view of an arrowhead according to another embodiment.

Embodiment of FIGS. 12–14

The arrowhead construction illustrated in FIGS. 12–14 makes it possible for an archer to apply heads according to the invention to any standard tubular metal arrow shaft. Here, the arrowhead comprises a main body 71, a closure member 72 which serves also as the arrow point, and a blade assembly 73. Body 71 has a flat transverse leading end face 74, a trailing end portion 75 and an intermediate portion 76. Portion 76 has a right circular cylindrical outer surface of a diameter equal to that of the outer surface of arrow shaft 82. Portion 75 has a right circular cylindrical outer surface of a diameter substantially eaqual to the inner diameter of the arrow shaft, the outer surfaces of portions 75 and 76 being joined by a rearwardly facing transverse annular shoulder 78. Body 71 has a blind axial bore 77 which opens through face 74 and extends completely through portion 76 and also through portion 75 to terminate in a blind end spaced forwardly from the trailing end of portion 75. The main body also has four slots 79 which extend from shoulder 78 forwardly, opening through leading end face 74. Slots 79 are radial with respect to body 71, open completely through the annular wall which defines bore 77 forwardly of shoulder 78, and are spaced apart circumferentially of body 71 by 90°. A relatively short portion of the leading end of body 71 is externally threaded as indicated at 74*a*.

Blade assembly 73 includes mandrel 86 and four blades 87. Mandrel 86 is a straight rod of circular transverse cross section, the diameter of the mandrel being uniform throughout the length of the mandrel and substantially equal to that of bore 77, so that the mandrel can be slidably embraced by the wall of bore 77. Blades 87 are mutually identical, each having a straight edge 87*a* joined rigidly to the mandrel, a straight leading edge 87*b*, a straight trailing edge 87*c* and a straight outer cutting edge 87*d* which slants forwardly toward the mandrel. The blades are flat, have a thickness slightly less than the width of slots 79 so the blades can be slidably received in the slots, and lie in planes which include the longitudinal axis of the mandrel and are spaced apart by 90°. The length of blades 87 is equal to the distance from shoulder 78 to the trailing end of threaded portion 74*a*. The length of the mandrel is such that, when the mandrel is inserted rearwardly into bore 77 until the trailing end of the mandrel engages the blind trailing end of the bore, a substantial portion of the mandrel projects forwardly from leading end face 74 of body 71. Blades 87 are so located on the mandrel that, when the mandrel has been inserted fully into body 71, each blade is accommodated by a different one of slots 79, the leading edges 87*b* all lie in a common plane at the trailing end of threaded portion 74*a*, and the trailing edges 87*c* all lie in the plane of shoulder 78 so that the annular tip of the arrow shaft constitutes a stop surface extending across the trailing end of each slot.

Point member 72 is conical and has a threaded rearwardly opening axial bore portion 84 of the same diameter as male threaded portion 74*a* of body 71, so that the point member can be threaded onto the leading end of the main body. The point member also has an axial blind bore portion 85 which opens rearwardly into bore portion 84, the diameter of bore portion 85 being such that the leading end portion of mandrel 86 can be slidably received therein. Point member 72 is completed by an external groove 95 dimensioned to accept, e.g., the edge of a coin so that the coin can be used to torque the point member as the point member is threaded onto portion 74*a* of body 71.

In use, trailing end portion 75 of the main body is inserted into the tip of the tubular arrow shaft 82 and secured rigidly thereto, as by adhesive. With blades 87 held in alignment with slots 79, mandrel 86 is inserted rearwardly into bore 77 until the trailing end of the mandrel engages the blind end of the bore. Tip member 72 is then threaded onto portion 74*a* of the main body until the blind end of bore portion 85 engages the leading end of the mandrel, so that the mandrel is clamped axially between the blind ends of bore 77 and bore portion 85, the parts occupying the positions shown in FIG. 14. With the tip member thus applied, the blades are clamped axially between the tip member and the stop surface presented by the tip of the arrow shaft.

It will be apparent that other blade assemblies can be provided for arrowheads according to this embodiment, such as the assemblies shown in FIGS. 4, 10 and 11, and that the parts can be interchanged to suit the activity involved.

Body 71 of the embodiment of FIGS. 12–14 can be modified, as seen in FIG. 15, to cooperate with an adaptor 96 rigidly secured in the tip of arrow shaft 82, the adaptor having a forwardly opening threaded bore 97 of a diameter larger than that of the axial bore of the main body. In such case, trailing end portion 75*a* of the main body is externally threaded throughout its length, so that the main body can be detachably secured to adaptor 96, and thus to the arrow shaft, simply by threading trailing end portion 75*a* into adaptor bore 97. In this modification, the axial bore of the main body is shortened so that the blind end of the bore is, e.g., at 77*a*, and the mandrel is correspondingly shortened.

Embodiment of FIG. 16

In this embodiment, again adapted for use with the standard tubular metal arrow shafts now common in the trade, the point of the arrowhead is integral with the mandrel, an adaptor is employed, and the trailing end of the mandrel is threaded for releasable attachment to the adaptor. The arrowhead thus comprises main body 101, adaptor 102 and blade assembly 103. The adaptor is again fitted into and rigidly secured to the tip of the conventional tubular arrow shaft 112 and has a forwardly opening threaded blind bore 114. Body 101 has a right circular cylindrical outer surface of a diameter equal to the outer diameter of the arrow shaft, the leading and trailing ends of the body being defined by flat transverse surfaces 101*a* and 101*b*, respectively. Axial bore 107 extends completely through body 101. Four slots 109 are provided, each extending longitudinally of the body from a point spaced forwardly from trailing end face 101*b* and opening through leading end face 101*a*, the slots lying in planes which include the longitudinal axis of bore 107 and are spaced apart by 90°.

Blade assembly 103 comprises mandrel 116 and, formed integrally with the leading end thereof, a conical point 104, the trailing end face of the point having an outer diameter equal to the outer diameter of body 101. The trailing end portion of the mandrel is threaded, as indicated at 116*a*, to cooperate with the threads of adaptor bore 114. The assembly also includes four flat blades 117 each having a straight edge 117*a* rigidly secured to the mandrel, a leading edge 117*b* secured to the trailing end of point 104, a trailing edge 117*c* and an outer cutting edge 117*d* which slants forwardly and toward the mandrel to terminate at the periphery of the trailing end face of point 104. The blades are flat, of a thickness to be accepted by slots 109, and lie in planes which include the longitudinal axis of the mandrel and are spaced apart by 90°. Each blade can be provided with a projection 117*e* which extends forwardly from leading edge 117*b* and is received in a rearwardly opening socket in the trailing end of point 104.

With adaptor 102 having first been secured in the tip of the arrow shaft, the arrowhead is assembled by inserting mandrel 116 rearwardly through bore 107 of body 101, with blades 117 held in alignment with the respective slots 109, insertion being continued until trailing edges 117*c* of the blades engage the ends of slots 109 and the trailing end of point 104 engages the leading end of body 1. With the mandrel thus inserted through body 1, the threaded trailing end portion of the mandrel projects beyond the trailing end of body 1. The threaded trailing end portion of the mandrel is now threaded into bore 114 of the adaptor, using slot 120 in point 104 as an aid in applying torque to the mandrel, until body 1 is clamped axially between the leading ends of the arrow shaft and adaptor, on the one hand, and the trailing end of point 104, on the other hand.

It will be apparent that mandrel assembly 103 can be replaced by a bladeless assembly including only the mandrel and the integral tip, or by a mandrel assembly in which two of the blades are replaced by a cross rod, or by a four-bladed assembly of the construction shown in FIGS. 16 and 17 but with a circular penetration limiting and impact element added as in FIG. 10 or FIG. 11.

Embodiment of FIGS. 18 and 19

FIGS. 18 and 19 illustrate an embodiment of the invention specially adapted for use by a manufacturer of arrows having tubular metal shafts. Here, the arrowhead comprises a main body 201, a mandrel assembly 203 and a point member 204. Body 201 constitutes not only the main body of the arrowhead but also the adaptor means by which the head is fitted to the tubular arrowshaft 212. Body 201 has a solid trailing end portion 205, a right circular cylindrical outer surface 206 which extends from the trailing end of the body forwardly for most of the length of the body, a short forward portion which is enlarged to provide right circular cylindrical surface **206*a*, and a forwardly projecting tip which is of reduced diameter and externally threaded as shown at 206*b*. An axial bore 207 is provided and has a blind trailing end within solid trailing end portion 205, the bore extending throughout the remainder of the body and opening through the threaded forward tip. Body 201 has four slots 209 which lie in planes which include the longitudinal axis of the body, are radial with respect to the body, extend completely through the annular wall which defines bore 207, and are spaced apart by 90°. Opening through the threaded forward tip, the slots extend longitudinally for most of the length of bore 207** but stop at a transverse plane spaced forwardly a substantial distance from the blind end of the bore.

Surface portion **206*a* is of a diameter equal to the outer diameter of the arrow shaft. Surface 206 is of a diameter such that the portion of body 201 extending rearwardly from portion 206*a* can be slidably embraced by the inner surface of the arrow shaft. Surface portions 206 and 206*a* are joined by a transverse annular rearwardly facing shoulder 208. Arrow shaft 212 has four slots 209*a* which are identical in dimensions and disposition to slots 209. Body 201 is disposed with portion 205 embraced by the tip of the arrow shaft, shoulder 208 engaged with the end of the arrowshaft, and slots 209 each aligned radially with a different one of slots 209*a*, and the body is rigidly secured in that position, as by cement. Advantageously, body 201 can be installed in the arrow shaft before slots 209 have been cut, and slots 209 and 209*a*** can then be cut simultaneously.

Assembly 203 includes mandrel 216 and four blades 217, the blades being mutually identical and generally triangular. Each blade includes a straight edge which extends along and is rigidly secured to the mandrel, straight leading and trailing edges 219 and **219*a*, respectively, and a straight outer cutting edge 220 which slants forwardly toward the mandrel. The blades are flat and so arranged that each blade lies in a plane which includes the longitudinal axis of the mandrel, the blades being spaced apart by 90°. The mandrel is longer than the blades, a trailing end portion of the mandrel projecting rearwardly beyond the common plane of edges 219*a* by a distance equal to the axial space between the trailing blind ends of slots 209 and the blind end of bore 207. Similarly, a leading end portion of the mandrel projects forwardly beyond the common plane of edges 219**.

Point member 204 constitutes the closure member of this embodiment, serving not only as the point of the arrowhead but also as means for closing the open ends of slots 209 and **209*a* and clamping the blade assembly in place. Member 204 is conical and has a trailing end face of the same diameter as surface portion 206*a* of body 201. A threaded axial bore portion 214 opens through the trailing end face of member 204 and is of a length and diameter to coact with threaded tip 206*b* of body 201. A blind bore portion 215 extends forwardly from bore portion 214 and is of a diameter and length to accommodate the portion of mandrel 216** which projects forwardly from the leading edges of the blades.

With body 201 having been installed in the arrow shaft, and slots 209 and **209*a* provided, the arrowhead is assembled by aligning blades 217 each with a different one of slots 209 and inserting assembly 203 rearwardly into the combination of body 201 and the tip portion of the arrow shaft until the trailing end of the mandrel engages the blind end of bore 207 and trailing edges 219*a* of blades 217 abut the stop surfaces presented by the blind ends of slots 209 and 209*a*. Point member 204 is then telescoped over the leading end portion of the mandrel and threaded onto tip 206*b* until mandrel 216 is clamped axially between the blind ends of bore 207 and bore portion 215, while blades 217 are clamped axially between the trailing end face of tip member 204 and the blind ends of the respective slots 209 and 209*a***.

Again, blade assembly 203 can be replaced by a bladeless mandrel, or by an assembly such as that shown in FIGS. 18 and 19 but with two blades replaced by a cross rod as a penetration limiting and impact member, or by a four-bladed assembly having a circular penetration limiting and impact member provided in accordance with FIG. 10 or FIG. 11.

Blade Assembly of FIGS. 20–22

Using, e.g., the main body, arrow shaft and point member of FIGS. 18 and 19, blade assemblies such as that shown in FIGS. 20–22 can be employed, with the mandrel serving as a carrier, in the nature of a hinge pin, for the blades. Thus, assembly 250 comprises a pin or mandrel 251 and two blade units 252. Pin 251 is of the same length as but smaller diameter than mandrel 216, FIG. 18. Each blade unit 252 comprises two identical flat blades 253 in the form of a trapezoid, leading and trailing edges 254 and 255, respectively, being parallel, a third edge 256 extending at right angles to the leading and trailing edges, and outer cutting edge 257. In each blade unit, the two blades are joined along edges 256 by integral straps 258 each bent to extend for approximately 270° about a common axis, the radius of curvature of the straps being such that pin 251 can be inserted through the bent portions of the three straps and the straps will then embrace the pin so that the blade unit cannot be moved laterally relative to the pin. The blade units differ from each other only in that the locations of the straps 258 are staggered so that straps 258 of one blade unit can be inserted between the straps of the other blade unit in the fashion shown in FIG. 20. In each blade unit, the two blades 253 lie in planes which are at right angles to each other and diverge away from the longitudinal axis established by bent straps 258. Thus, when the two blade units are fitted together and pin 251 is inserted through the bent straps of both blade units, the two blade units are held by the pin in such fashion that the four blades 253 can be aligned respectively with the four slots 209, FIG. 18, of the main body, and blade assembly 250 can be inserted into the main body in the same manner described for assembly 203, FIGS. 18 and 19.

Blade Assembly of FIGS. 23–25

As illustrated in FIGS. 23–25, the mandrel can be completely eliminated from the blade assembly. Thus assembly 300 comprises only two blade units 301, each being an integral flat piece presenting two identical blades 302. When the assembly is to be used with main body 201 and point member 204 of the embodiment of FIGS. 18 and 19, each blade has a leading edge 303 and a trailing edge portion 304 which are mutually parallel and at right angles to the longitudinal center line of the blade assembly, the length of edge 303 being slightly greater than the radius of shoulder 206*a*, FIG. 18, and the length of trailing edge portion 304 being at least equal to the radius of surface 206. The trailing edge of each blade is completed by a straight outer portion 305 which slants rearwardly from the outer end of portion 304. Each blade has a straight cutting edge 306 which interconnects the outer end of portion 305 and the outer end of leading edge 303. Each blade has a triangular medial opening 307, the edges of the opening being respectively parallel to the center line of the blade unit, the outer cutting edge, and trailing edge portion 305. One blade unit has a rearwardly opening straight slot 308 extending along the center line of the unit for half the length of the unit. The other blade unit has a forwardly opening straight slot 309 extending along the center line for half the length of the unit. The assembly is prepared for insertion into the main body member by inserting the unslotted portion of one blade unit into the slot of the other blade unit while both blade units taper in the same direction. When assembly 300 has been inserted into main body 201, FIG. 18, and point member 204 applied as in FIG. 19, blades 302 substantially fill the widths of the respective slots in the main body and proper threaded engagement between the threaded tip of the main body and the threaded bore of the point member is preserved even under impact. When the arrowhead is to be used for target shooting, the blade assembly is removed and replaced by a bladeless mandrel which fills the bores of the main body and point member.

FIG. 26 illustrates a two-bladed form of assembly, similar to that of FIGS. 23–25 and intended for use without a mandrel. Here, the blade assembly consists of one of the blade units 301 and one flat piece 310. Piece 310 is of a length equal to the distance between edges 303 and 304 of unit 301, is only as wide as the diameter of main body 201, and is forwardly slotted. Unit 301 is rearwardly slotted and unit 301 and piece 310 are interfitted in the manner described with reference to FIGS. 23–25. Use of piece 310 allows all four slots of body 201 to be filled, so that the threaded point member 204 can be properly installed even though the arrowhead thus assembled has only two blades.

Embodiment of FIGS. 27–29

FIGS. 27–29 illustrate how a blade assembly of the general type shown in FIGS. 23–25 can be modified to provide two blades and a penetration limiting and impact member and also how the need for a mandrel when the head is used for target shooting can be eliminated. Indicated generally at 350, the blade assembly consists of one blade unit 351 and a penetration limiting and impact member 352. Blade unit 351 is a flat metal piece presenting two blades 353 each of the same configuration as blades 302, FIGS. 23–25 except that the trailing edges of the blades extend as a single straight line parallel to the leading edge and at right angles to the leading edge. The single piece constituting unit 351 is provided with a rearwardly opening straight slot which extends along the center line of the unit for half the length of the unit in the same manner as does slot 308, FIG. 23.

Member 352 is also in the form of a single flat metal piece and is generally T-shaped so as to include an elongated portion 354 of rectangular plan form, which constitutes the stem of the "T", and two laterally extending portions 355 which are also of rectangular plan form. Portions 355 are mutually identical and each has a straight leading edge portion 356 which is bent back to lie against the main body of portion 355, so that the leading edge of portion 355 is of double thickness and presents a blunt face, rather than a cutting edge, as indicated at 356*a*, FIG. 28. Member 352 has a forwardly opening slot 357 which extends along the center line of portion 354 for half the length of member 352, so that member 352 and blade unit 351 can be interfitted in the same manner described with reference to FIGS. 23–25.

In this embodiment, blade assembly 350 forms one component of an arrowhead combination also including a main body 361 and a point member 364. Body 361 includes a trailing end portion 365, an elongated intermediate portion 366 and a forwardly extending externally threaded projection 366*a*. Trailing portion 365 is of circular transverse cross section, the outer surface thereof being annularly serrated to provide annular pockets 365*a*. The diameter of portion 365 is such that that portion can be inserted into the hollow tip of an arrow shaft 367 and secured thereto by cement, with pockets 365*a* accommodating annular rings of cement. Adjacent portion 365, portion 366 has a right circular cylindrical outer surface of the same diameter as the outer surface of the arrow shaft, and a transverse annular rearwardly facing shoulder 368 is provided to be abutted by the tip of the arrow shaft. Portion 366 tapers forwardly to provide a cylindrical outer surface of smaller diameter adjacent the leading end of body 361. Body 361 is provided with two slots 369 and 370, FIG. 29, which extend radially completely through the body and longitudinally from a point spaced forwardly from shoulder 369 to open through the forward tip of projection 366*a*. Slots 369, 370 extend in planes which include the central axis of body 361 and are at right angles to each other. Thus, when blade unit 351 and member 352 have been assembled, the assembly is inserted rearwardly into body 361, with the two blades of unit 351 accommodated by slot 369 and member 352 accommodated by slot 370, as will be clear from comparison of FIGS. 27 and 29. While the cross bar portions of the "T" of member 352 project from slot 370, portion 354 is completely housed in slot 370.

Point member 364 has an annular rearwardly projecting skirt 372 which is internally threaded and dimensioned to be threaded onto externally threaded projection 366a of main body 361. Projection 366a has an axial bore 373 which opens through the leading end of projection 366a and has a blind end lying in the transverse plane defined by the leading ends of slots 369, 370. Point member 364 has an integrally formed rearwardly projecting stub shaft 374 having a diameter to be slidably accommodated by bore 373 and a length such that, when the point member has been fully threaded onto projection 366a, the end of stub shaft 374 engages the blind end of bore 373. When assembly 350 is in place and point member 364 has been fully threaded onto the main body, blade unit 351 and member 352 are clamped axially between the trailing edge of skirt 372 and the trailing end of stub shaft 374, on the one hand, and the trailing ends of slots 369 and 370, on the other hand. For target shooting, when blade assembly 350 has been removed, no mandrel is required, since stub shaft 374 of the point member completely fills bore 373 and prevents inward flexing of projection 366a even though slots 369, 370 are empty. While the main portion of body 361 does not have an axial bore, slots 369 and 370 intersect at the center of the body, the intersection causing there to be an axial space which is blind at the trailing ends of the slots and opens forwardly into the short bore 373 and thus forwardly through projection 366a. It will be apparent that blade assembly 350 can be replaced by a mandrel-less four-bladed assembly such as that shown in FIGS. 23–25.

Embodiment of FIG. 30

Though the embodiments described above comprise blades which lie in planes which are radial with respect to the main body of the arrowhead, radial disposition of the blades is not always required. Thus, FIG. 30 illustrates an arrowhead according to the invention which employs two non-radial blades which are part of an integral blade assembly which requires no mandrel. Here, main body 381 is constructed generally as body 201, FIG. 18, and includes an axial bore 382 and two slots 383 and 384 which extend longitudinally of the body and lie in parallel planes which are spaced apart across a diameter of bore 382 and are tangential with respect to the circular transverse cross section of the bore, the two slots commencing along lines on the circumference of the bore and opening outwardly in opposite directions. Blade assembly 385 is an integral piece, including two identical blades 386 and 387 joined along their inner edges by a straight flat strip 388 of a width substantially equal to the diameter of bore 382, so that the assembly is substantially Z-shaped. Assembly 385 is inserted through the open ends of slots 383 and 384 and bore 382, so that each blade is retained in a different one of the slots and strip 388 is wholly disposed in the bore.

In all embodiments, quick and easy loading of the selected blade assembly into the main body is made possible by the fact that the body is slotted completely through one end and has an axial space opening through the same end of the body so that the blade assembly can be inserted through that end of the body into its final position. It will be apparent that various modifications can be made without departing from the scope of the invention. Thus, for example, the main body can be provided with three slots spaced circularly about the body by 120° and the blade assembly can have three blades each disposed to enter a different one of the three slots when the blade assembly is inserted into the main body. A bladeless mandrel can be employed which includes not only a rigid cross member, as rod 18, FIGS. 1–5, or member 352, FIGS. 27–29, but also a second cross member spaced forwardly and of spring wire of a diameter capable of being accepted by the slots of the main body. It will be apparent that the archer can be supplied with a kit including a main body, a closure member, an adaptor (when one is required), and a plurality of different blade assemblies, as well as a bladeless mandrel (when one is required). Regardless of which blade assembly is used, the complete arrowhead will have the advantages of total rigidity, ease of assembly and of interchange of the blade assemblies, and a high degree of reliability.

What is claimed is:

1. In an arrow, the combination of an arrow shaft having a tubular tip provided with a plurality of circumferentially spaced longitudinal slots which open through the free end of the tip;

an arrowhead body secured within the tubular tip of the arrow shaft and having a plurality of longitudinal slots and an axially extending space, a leading end portion of the arrowhead body projecting forwardly from the tip of the arrow shaft and the slots and axial space of the body opening forwardly through said leading end portion, the slots of the body each being aligned with a different one of the slots of the arrow shaft;

a blade assembly comprising at least two blades and being constructed and arranged to be inserted into the arrowhead body via the open ends of the axially extending space and the slots of both the body and the arrow shaft until the blades are each accommodated by a different one of the aligned pairs of slots of the body and the arrow shaft; and a closure member releasably secured to the leading end portion of the arrowhead body to close the slots and axial space and retain the blade assembly in place.

2. In an arrowhead, the combination of an elongated main body adapted to be secured to the tip of an arrowshaft and having a leading end, an intermediate portion and a trailing end, an axial space which opens through one end of the body and extends for at least a substantial part of the length of the body, a plurality of slots which extend both longitudinally and laterally relative to the main body, open longitudinally through said one end of the body and open both outwardly throuth the outer surface of the body and inwardly into the axial space, and at least one internal stop surface which is spaced from said one end of the body toward the other end, faces toward said one end and is axially exposed toward said one end via said axial space and said slots;

a blade assembly comprising at least two blades and being constructed and arranged to be inserted into the main body via the open ends of the axial space and the slots until the blades are each accommodated by a different one of the slots and the assembly is engaged with said at least one stop surface; and a closure member releasably secured to said one end of the main body to close the open ends of the slots and secure the blade assembly in a position in which the assembly is clamped axially against said at least one stop surface, said blade assembly including an elongated mandrel which carries said blades;

said axial space comprising a bore dimensioned to accommodate said mandrel, said bore having a blind end which constitutes said at lease one stop surface;

said slots and said bore opening through the leading end of the main body.

3. The combination defined by claim 2, wherein the blades are rigidly joined to the mandrel.

4. The combination defined by claim 2, wherein the slots also have blind ends which constitute stop surfaces to be engaged by the blades.

5. The combination defined by claim 2 wherein the mandrel includes a leading end portion which projects forwardly from the blades; and said closure member comprises a point member which has a rearwardly opening axial blind bore to accommodate the leading end portion of the mandrel, the length of the mandrel and the bores being such that, when the point member is secured to the main body, the mandrel is clamped axially between the blind ends of the bores.

6. The combination defined by claim 2, wherein the blade assembly has a longitudinal axis and a plurality of blades spaced equally about said axis, each of the blades having an outer trailing portion, the blade assembly further comprising an annular penetration limiting and impact element which is rigidly secured to the outer trailing portions of the blades and is concentric with said axis.

7. The combination defined by claim 6, wherein each of the blades has an outer rearwardly projecting extension and the annular penetration limiting and impact element is secured to said extensions.

8. The combination defined by claim 2, wherein the blade assembly comprises a longitudinally extending central pin and two blade units carried by the pin, each blade unit comprising two flat blades disposed with like edges adjacent and parallel to each other, and at least one portion integral with both blades and extending through more than 180° to embrace the pin and prevent the blade unit from being displaced laterally from the pin, the two blades lying in planes at right angles to each other.

9. The combination defined by claim 2, wherein the main body has two slots which extend along different intersecting diameters of the main body so as to intersect each other along the longitudinal axis of the body, the slots opening through only one end of the body and intersection of the slots providing said axial space; and the closure member is a point member having a first rearwardly projecting portion which is threaded to engage cooperating threads on the main body to secure the point member to said one end of the main body, the point member also having a second rearwardly projecting portion which is coaxial with said first rearwardly projecting portion, a portion of the main body being clamped between said first and second rearwardly projecting portions when the point member is secured to the main body.

10. The combination defined by claim 9, wherein the first rearwardly projecting portion of the point member is an internally threaded skirt;

the main body has a forwardly projecting tip portion which has external threads to cooperate with the threads of the skirt and is provided with a forwardly opening bore to accommodate the second rearwardly projecting portion of the point member.

11. In an arrowhead, the combination of an elongated main body adapted to be secured to the tip of a tubular arrow shaft, said tubular arrow shaft having a leading end portion, said main body having a leading end, an intermediate portion and a trailing end, an axial space which opens through said leading end of body and extends for at least a substantial part of the length of the body, a plurality of slots which extend both longitudinally and laterally relative to the main body, open longidudinally through said leading end of the body and open both outwardly through the outer surface of the body and inwardly into the axial space, the trailing end portion of said main body shaped and dimensioned so as to be insertable into said leading end portion of said tubular arrow shaft and secured thereto, and at least one internal stop surface which is spaced from said leading end of the body toward the trailing end, faces toward said leading end and is axially exposed toward said one end via said axial space and said slots;

a blade assembly comprising at least two blades and being constructed and arranged to be inserted into the main body via the open ends of the axial space and the slots until the blades are each accommodated by a different one of the slots and the assembly is engaged with said at least one stop surface; and a closure member releasably secured to said one end of the main body to close the open ends of the slots and secure the blade assembly in a position in which the assembly is clamped axially against said at least one stop surface.

12. In an arrowhead, the combination of an elongated main body adapted to be secured to the tip of a tubular arrow shaft and having a leading end, an intermediate portion and a trailing end, an axial space which opens through the leading end of the body and extends for at least a substantial part of the length of the body, a plurality of slots which extend both longitudinally and laterally relative to the main body, open longitudinally through said leading end of the body, extend to a location near the trailing end of the main body and open both outwardly through the outer surface of the body and inwardly into the axial space, said main body having a right circular cylindrical outer surface extending from the trailing end to a point near said leading end and being of such a diameter as to be slidably embraceable by the tip portion of said tubular arrow shaft, and at least one internal stop surface which is spaced from said one end of the body toward the other end, faces toward said one end and is axially exposed toward said one end via said axial space and said slots;

a blade assembly comprising at least two blades and being constructed and arranged to be inserted into the main body via the open ends of the axial space and the slots until the blades are each accommodated by a different one of the slots and the assembly is engaged with said at least one stop surface; and a closure member comprising a point member releasably secured to said one end of the main body to close the open ends of the slots and secure the blade assembly in a position to which the assembly is clamped axially against said at least one stop surface.

13. The combination defined by claim 12, wherein the leading end of the main body includes a forwardly projecting externally threaded tip; and the point member is conical, has a flat trailing end face and has a threaded bore which opens through the trailing end face to receive the threaded tip of the main body.

14. The combination defined by claim 13, wherein the threaded tip of the main body is of reduced diameter and the diameter of the trailing end face of the point member is equal to that of the portion of the main body from which the threaded tip projects.

15. In an arrowhead, the combination of an elongated main body adapted to be secured to the tip of an arrow shaft and having a leading end, an intermediate portion and a trailing end, an axial space which opens through one end of the body and extends for at least a substantial part of the length of the body, four slots arranged in diametrically aligned pairs which extend both longitudinally and laterally relative to the main body, open longitudinally through said one end of the body and open both outwardly through the outer surface of the body and inwardly into the axial space, and at least one internal stop surface which is spaced from said one end of the body toward the other end, faces toward said one end and is axially exposed toward said one end via said axial space and said slots;

a blade assembly comprising two blade units each capable of being disposed in a different diametrically opposed pair of said slots and being constructed and arranged to be inserted into the main body via the open ends of the axial space and the slots until the blades are each accommodated by a different one of the slots and the assembly is engaged with said at least one stop surface;

one of said blade units having a longitudinally extending slot which extends along the center line of the blade unit for only a portion of the length of the blade unit and opening forwardly, the other of the blade units having a longitudinally extending slot which extends along the center line of the blade unit and opens rearwardly, said two blade units being interengaged with the unslotted portion of one blade unit engaged in the slotted portion of the other blade unit, one of the blade units including two arm portions which project outwardly from the trailing end portion of the blade unit and having leading edges spaced rearwardly from the leading end of the blade unit and constituting penetration limiting and impact elements rather than cutting edges, said leading edges of said one blade unit comprising a portion of each of said arms bent rearwardly to lie upon one side of that arm; and a closure member releasably secured to one end of the main body to close the open ends of the slots and secure the blade assembly in a position in which the assembly is clamped axially against said at least one stop surface.

16. In an arrowhead, the combination of an elongated main body adapted to be secured to the top of an arrow shaft and having a leading end face and a trailing end face, an axial bore which opens through both ends of the body and extends throughout the length of the body, a plurality of slots each of which extend longitudinally and laterally relative to the main body, from a point spaced forwardly from the trailing end face and open through the leading end face of the main body a blade assembly comprising a mandrel having a leading end and a trailing end, a conical point integral with the leading end, at least two blades secured to the mandrel, the trailing end of the mandrel projecting rearwardly of the blades and being externally threaded, said mandrel and blades inserted into the axial bore and said slots until the blades are each accommodated by a different one of said slots, and an adaptor member fitted into and secured to the tip of said arrow shaft and having a forwardly opening threaded bore into which the threaded trailing end portion of the mandrel is threaded.

17. The combination defined in claim 16, wherein the slots each have a closed trailing end, all of said closed ends lying in a common plane transverse to the longitudinal axis of the main body and constituting stop surfaces against which the blades can be clamped.

* * * * *